US012064035B2

(12) United States Patent
Olarte

(10) Patent No.: US 12,064,035 B2
(45) Date of Patent: Aug. 20, 2024

(54) SEAT CONNECTION MECHANISM USING METALLIC AND POLYMER COMPONENTS

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

(21) Appl. No.: 18/351,015

(22) Filed: Jul. 12, 2023

(65) Prior Publication Data

US 2024/0016294 A1 Jan. 18, 2024

Related U.S. Application Data

(60) Provisional application No. 63/389,129, filed on Jul. 14, 2022.

(51) Int. Cl.
*A47C 1/121* (2006.01)
*A47C 7/56* (2006.01)
*A47C 7/58* (2006.01)

(52) U.S. Cl.
CPC ..... *A47C 1/121* (2013.01); *A47C 7/56* (2013.01); *A47C 7/58* (2013.01)

(58) Field of Classification Search
CPC ..... A47C 1/121; A47C 7/58
See application file for complete search history.

(56) References Cited

U.S. PATENT DOCUMENTS 1,973,178 A * 9/1934 Sass ..... A47C 7/58 297/333
2,913,039 A * 11/1959 Mauser ..... A47C 7/58 297/333
3,727,975 A * 4/1973 Anderson ..... A47C 1/121 297/332
3,813,149 A * 5/1974 Lawrence, III ..... A47C 1/12 297/335
4,883,319 A * 11/1989 Scott ..... B60N 2/22 403/162
5,375,914 A * 12/1994 Donnelly ..... A47C 1/121 297/335
7,000,989 B2 * 2/2006 Fisher ..... A47C 1/16 297/335
8,020,254 B2 * 9/2011 Lin ..... E05D 11/087 16/334
9,295,334 B2 * 3/2016 Olarte ..... E05D 5/14
11,026,515 B2 * 6/2021 Olarte ..... F16M 13/02
(Continued)

FOREIGN PATENT DOCUMENTS

CN 205311384 U * 6/2016

*Primary Examiner* — Robert Canfield
(74) *Attorney, Agent, or Firm* — FARBER LLC; Jonathan Winter

(57) ABSTRACT

A seat connection mechanism and a seat employing that mechanism where the mechanism is constructed from a combination of metal, for example extruded or cast, plastic bushings and plastic covers to create a fully enclosed tilt mechanism for seats which is reliable, easy to maintain and allows for easy removal of seats for repair thereof so long as the person removing the seat knows the removal process. Thus vandalism is inhibited and a relatively economical bracket and seat is provided with substantial durability and reliability.

18 Claims, 8 Drawing Sheets

(56) References Cited

U.S. PATENT DOCUMENTS

| | | | | |
|---|---|---|---|---|
| 11,464,337 | B1 * | 10/2022 | Olarte | A47C 7/16 |
| 11,684,160 | B1 * | 6/2023 | Olarte | A47C 1/121<br>297/337 |
| 11,712,118 | B2 * | 8/2023 | Olarte | A47C 1/126<br>248/220.21 |
| 2003/0090136 | A1 * | 5/2003 | Olarte | A47C 1/121<br>297/335 |
| 2004/0084943 | A1 * | 5/2004 | Fisher | A47C 1/121<br>297/335 |
| 2004/0100134 | A1 * | 5/2004 | Plant | A47C 7/56<br>297/331 |
| 2008/0203790 | A1 * | 8/2008 | Olarte | A47C 1/12<br>297/331 |
| 2013/0057036 | A1 * | 3/2013 | Olarte | E05D 5/12<br>16/386 |
| 2019/0329673 | A1 * | 10/2019 | Popescu | F16C 33/20 |
| 2021/0321776 | A1 * | 10/2021 | Plant | A47C 1/121 |

* cited by examiner

SEAT CONNECTION MECHANISM USING METALLIC AND POLYMER COMPONENTS

FIELD OF THE INVENTION

The following relates to seating, more particularly a mechanism allowing a seat to tilt up/down.

BACKGROUND OF THE INVENTION

A number of seat connection mechanisms have been designed to allow seat bottoms to tilt up and down. Some are spring loaded and others use counterweight/gravity to automatically lift the seat when a user is not sitting in it. Such seats are found in a number of auditoriums such as theaters/concert halls, movie theaters, sports venues and others where the seat structure is often bolted or otherwise affixed to the floor. Such seats are referred in the industry as "fixed seating". Occasionally tilt mechanisms are needed for moveable chairs which can be stored when not in use.

In either case, seats are provided in large quantities and are installed in places where they are used heavily. The mechanism thus needs to be reliable, robust and must withstand significant use as well as provide tamper resistance to avoid vandalism. The mechanism should also resist becoming clogged with e.g. drinks/popcorn/snacks which are often consumed in locations where such seats are present. In outdoor uses such as sports stadiums, weather resistance is also important.

Given the large quantities of seats, the cost of installing large jobs with thousands of seats also demands economical components. Being price competitive is often a determining factor for winning seating jobs. Thus, an improved seat connection/tilt mechanism is therefore needed to meet the reliability demands in a cost effective manner.

Some known seat connection mechanisms have been made using injection molded parts that utilize relatively thick part walls and use the plastic for structural stability and support. Often, the complex shapes and cavities needed to fully enclose the rotating parts for safety has dictated relatively expensive molds and manufacturing techniques. For example, U.S. Pat. No. 9,295,334, which is incorporated by reference herein, discloses a fully enclosed pivot mechanism which uses a non-cylindrical pin with an arm mounted thereto (FIG. 8). In one embodiment of the present invention, this same pin and arm design is used. U.S. Pat. No. 9,295,334 provides a polymeric bracket body 200 which can be expensive to manufacture due to the relatively thick walls and complex molds. Further, the bearing/bushing surface may wear out over lengthened periods of use, which would require replacement of the entire bracket.

While metal brackets have been designed in the past, they often suffer the disadvantage of providing a complex to assemble seat to frame system. More particularly, seats and their upholstery can become torn or damaged or dirty and cleaning can be indicated. If the seat is too difficult to remove, the seat supplier will have to make a service call or someone trained to disassemble the seats will be needed. Thus, traditionally metal brackets have been avoided when providing seat connection/tilt mechanisms with fully enclosed moving parts. Some mechanisms have been provided in metal with exposed moving parts, but these moving parts can cause injury through pinched fingers etc, which is desirable to avoid.

What is therefore desired is to provide an improved seat connection mechanism that is both robust and economical to manufacture.

SUMMARY OF THE INVENTION

It is therefore an object of the invention to provide a seat connection mechanism which utilizes metallic parts when possible to provide structural support.

It is a further object of the invention to provide a seat connection mechanism which allows for replacement of wear parts.

It is yet a further object of the invention to provide a seat connection mechanism which encloses moving parts which can create a pinching risk.

These and other objects are achieved by providing a seat connection mechanism and a seat employing that mechanism where the mechanism is constructed from a combination of extruded metal, plastic bushings and plastic covers to create a fully enclosed tilt mechanism for seats which is reliable, easy to maintain and allows for easy removal of seats for repair thereof so long as the person removing the seat knows the removal process. Thus vandalism is inhibited and a relatively economical bracket and seat is provided with substantial durability and reliability.

In a seat connection mechanism is provided and includes a bracket portion which is a metallic extrusion including an open upper portion, a pivot support and two stops. A pin portion includes a support portion and a stop portion. A polymeric bushing inserts into the bracket portion at the pivot support in a fixed rotational position relative to the bracket portion such that the busing is located between the pivot support and the support portion of the pin portion. A cover portion is configured to cover the open upper portion to enclose the open upper portion of the bracket portion. The pin portion is configured to rotate in contact with the polymeric bushing such that the stop portion of the pin portion moves between the two stops of the bracket portion.

In certain aspects, a channel in the bracket portion is arranged approximately perpendicular to an extrusion direction of the metallic extrusion. In other aspects the channel passes through the pivot support. In still other aspects an open lower portion is provided on the bracket portion and a second cover portion is configured to cover the open lower portion. In still other aspects the second cover portion and the polymeric bushing are configured to interact to hold themselves together to secure both the polymeric bushing and the second cover portion to the bracket portion. In other aspects the polymeric bushing is configured to connect to a lower cover to hold the lower cover relative to the bracket portion. In still other aspects the connection between the polymeric bushing and the lower cover inhibits movement of the lower cover in an axial direction of the pin portion. In yet other aspects the lower cover includes catches which interact with the bracket portion to hold the lower cover to the bracket portion. In still other aspects the channel is arranged on an inwards facing side of the bracket portion and the polymeric bushing is configured to connect to a lower cover to inhibit the lower cover from moving outwards. In still further aspects, the lower cover includes a face which abuts an outer surface of the bracket portion to inhibit the cover from moving inwards.

In other aspects a seat connection mechanism is provided including a bracket portion which is a metallic extrusion including an open upper portion, a pivot support and two stops. A pin portion is configured to rotate about a rotation axis and the pin portion includes a support portion and a stop portion. A polymeric bushing inserts into the bracket portion at the pivot support. The pin portion is configured to rotate within the pivot support in contact with the polymeric bushing such that the stop portion of the pin portion moves between the two stops of the bracket portion. A first cover portion interacts with the bushing to limit movement of the first cover along the rotation axis, the first cover at least partially covering a rotation space defined within the bracket portion, the rotation space being defined as an area through which the stop portion moves when traveling between the two stops.

In other aspects the bracket portion includes a lower portion defining the rotation space and the lower portion is a through opening covered by the first cover portion. In still other aspects a through opening extends through the bracket portion adjacent each of the two stops. In yet other aspects the pivot support is positioned between the through openings in the bracket portion. In still further aspects the pivot support connects at a lower end thereof to a support portion which support portion connects one of the two stops to the pivot support. In still further aspects the bracket portion includes a mounting through hole therein positioned within a section of the bracket portion which contains one of the two stops.

In further aspects a seat rotation mechanism includes a bracket portion with a pivot support region and at least one stop region. A bushing is made of a polymeric material. A cover is configured to at least partially cover the bracket and a seat comprising a pin, the pin configured to rotate in contact with the bushing. The bushing is configured to fit in the pivot support region such that the bushing is supported by the bracket and the bushing is configured to interact with the cover such that the cover inhibits removal of the bushing from the pivot support region and the bushing interacts with the cover to inhibit removal of the cover from the bracket.

In further aspects a seat is provided including a support leg, a backrest, a seat and a seat connection. The seat connection mechanism is configured to connect the seat to the backrest, the seat connection mechanism further configured to connect to the support leg, the seat connection mechanism including: a bracket portion which is a metallic extrusion including an open upper portion, a pivot support and two stops; a pin portion which includes a support portion and a stop portion; a polymeric bushing which inserts into the bracket portion at the pivot support in a fixed rotational position relative to the bracket portions such that the busing is located between the pivot support and the support portion of the pin portion; and a cover portion which is configured to cover the open upper portion to enclose the open upper portion of the bracket portion. The pin portion is configured to rotate within a cavity of the bracket in contact with the polymeric bushing such that the stop portion of the pin portion moves between the two stops of the bracket portion. The cavity is enclosed by a support leg section which is a portion of the support leg which covers the cavity from a side of the bracket opposite the seat.

In certain aspects the support leg comprises two support legs spaced apart with the backrest configured to connect on either side to one of the two support legs and wherein the seat connection mechanism comprises two seat connection mechanisms, each connected to one of the two support legs and wherein the pin portion of each seat connection mechanism is connected to the seat. In other aspects the bracket portion is mounted to the support leg section with one or more rivets which pass through both the bracket portion and the support leg section.

In yet further aspects a seat includes a support comprising a leg, a backrest, a seat and a seat connection mechanism which is configured to connect the seat to the backrest, the seat connection mechanism further configured to connect to the support. The seat connection mechanism includes a bracket portion which is a metallic extrusion including an open upper portion, a pivot support and two stops, a pin portion which includes a support portion and a stop portion and a polymeric bushing which inserts into the bracket portion at the pivot support in a fixed rotational position relative to the bracket portions such that the busing is located between the pivot support and the support portion of the pin portion. A cover portion comprises one or more pieces which cover the open upper portion to enclose the open upper portion of the bracket portion and cover a side of the bracket which faces the seat. The pin portion is configured to rotate within a cavity of the bracket in contact with the polymeric bushing such that the stop portion of the pin portion moves between the two stops of the bracket portion. The cavity is enclosed by a section of the support which covers the cavity from a side of the bracket opposite the seat.

Other objects of the invention and its particular features and advantages will become more apparent from consideration of the following drawings and accompanying detailed description.

DETAILED DESCRIPTION OF THE INVENTION

Figure 1A:
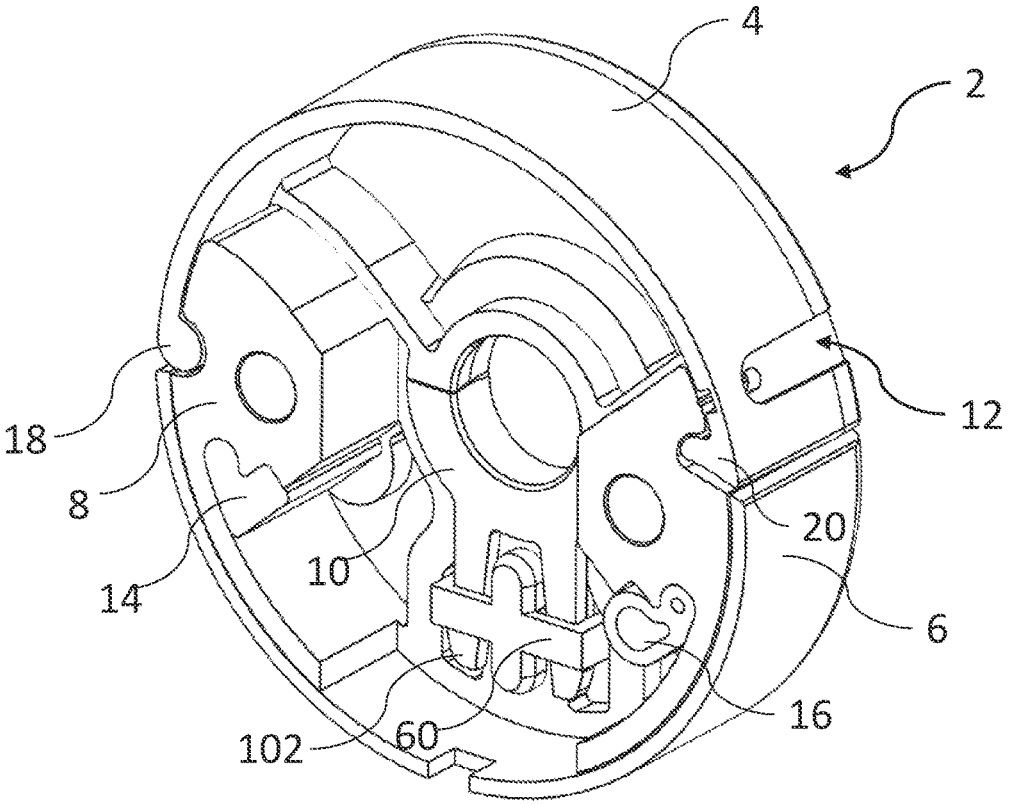
FIG. 1A is a perspective view of the inside of the connection mechanism according to the present invention with the pin removed.
Figure 1B:
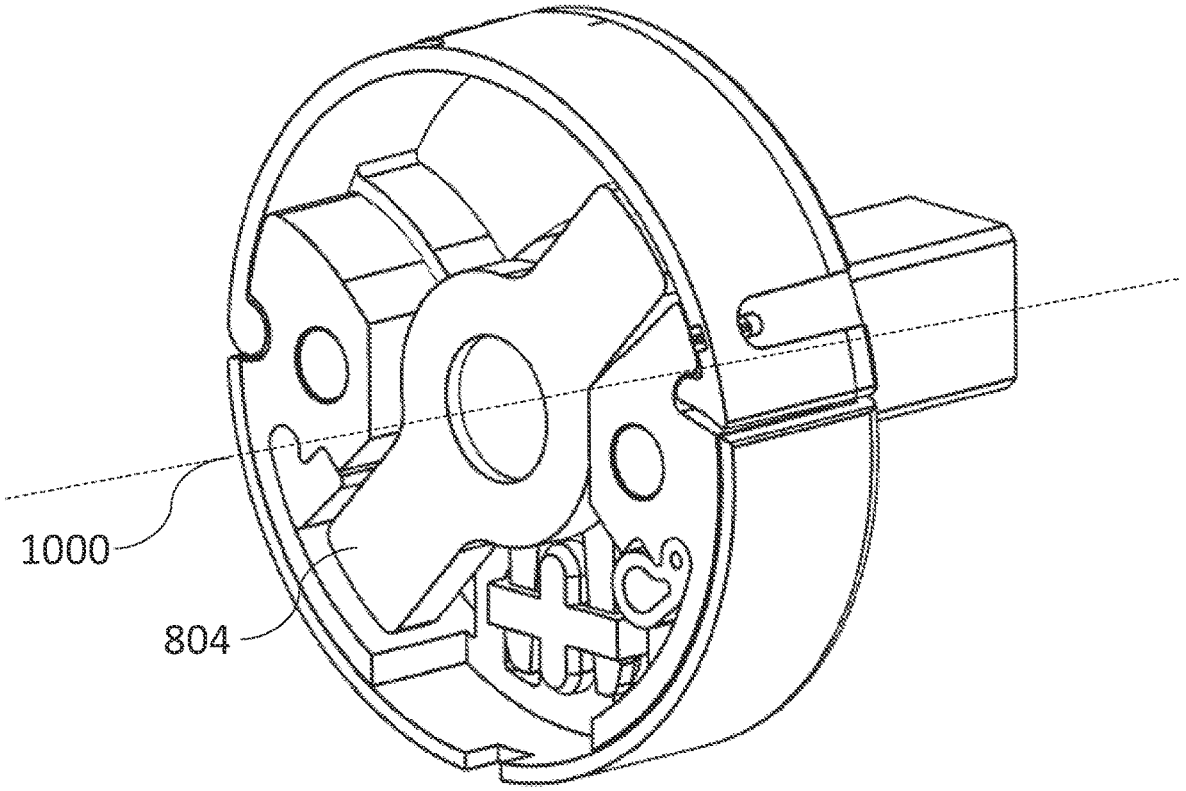
FIG. 1B is a perspective view according to FIG. 1A with the pin shown.

Referring now to the drawings, wherein like reference numerals designate corresponding structure throughout the views. The following examples are presented to further illustrate and explain the present invention and should not be taken as limiting in any regard.

Figure 6:
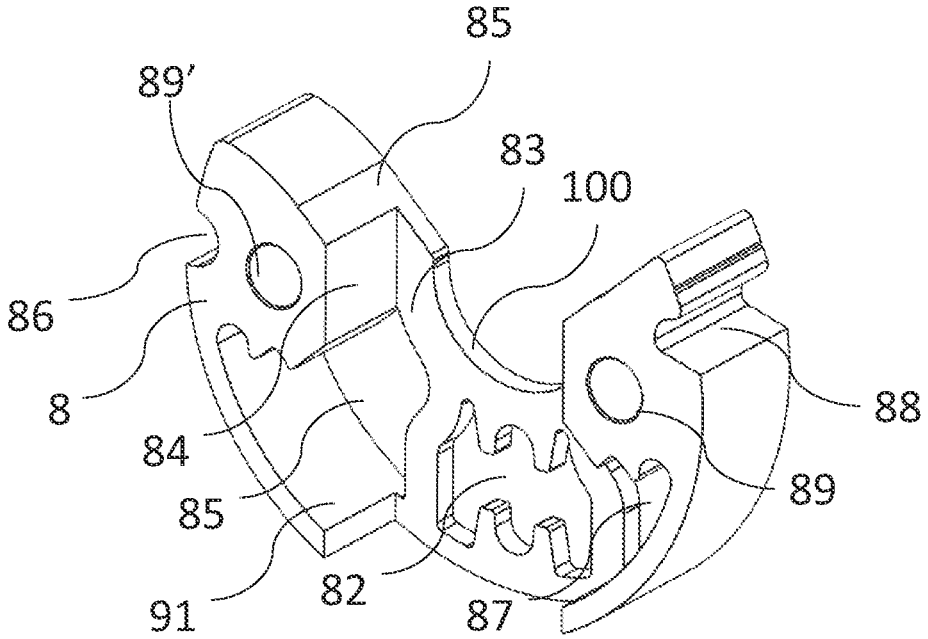
FIG. 6 shows the same view of FIG. 1A but with the bracket only shown.
Figure 7:
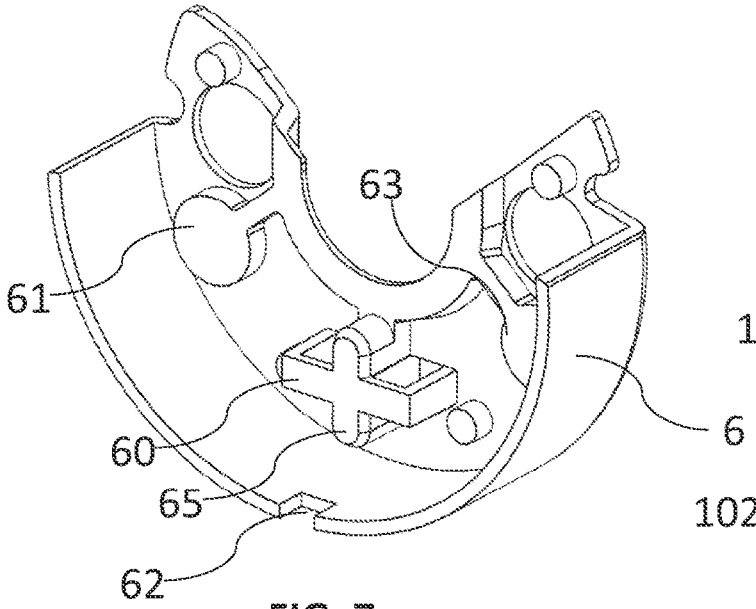
FIG. 7 shows the same view of FIG. 1A but with only the lower cover shown.

FIGS. 1A-C and 2-13 show the connection mechanism (or parts thereof). The main weight bearing component is the extruded bracket portion 8 which is preferably made of an extruded metal such as aluminum or steel. The bracket 8 is shown without other parts in FIG. 6 and as can be seen, the bracket 8 has a channel 84 cut therein. This channel is rather simple to manufacture/machine. A long extrusion can be produced having most of the features other than this channel 84. Particularly, this extrusion has the holes 82/85/87, the mounting holes 89/89', the cover securing recesses 88/86 along with the general outer shape of the bracket 8 formed therein. The elongated extrusion can then be cross cut to form individual brackets about 1.5 inches thick to form bracket sections (although other thicknesses are contemplated). Next, these bracket sections are placed in a jig to hold them with one side facing up and a milling machine can run a square cross section mill through multiple successive bracket sections to cut the channel 84, leaving shelf/pivot support section 83. As a result, simple cross cut of the extrusion and a straight milling operation can be accomplished in an economical fashion to minimize machining time and supply a durable and strong connection mechanism. Preferably a jig can be made with multiple holders for individual bracket sections so that processing is quick and repeatable.

With the channel 84 cut, the support portion 91 remains to connect the pivot support section 83/100 to the sides of the bracket. These sides as shown contain the bumper channels/stops and also include the mounting through holes which receive rivets for securing the bracket to the plate of the support leg. Preferably, the channel 84 goes all the way through the bracket in the direction across/perpendicular to the pivot axis 1000. As a result, liquids can drain out of the bracket and do not get trapped.

Figure 9:
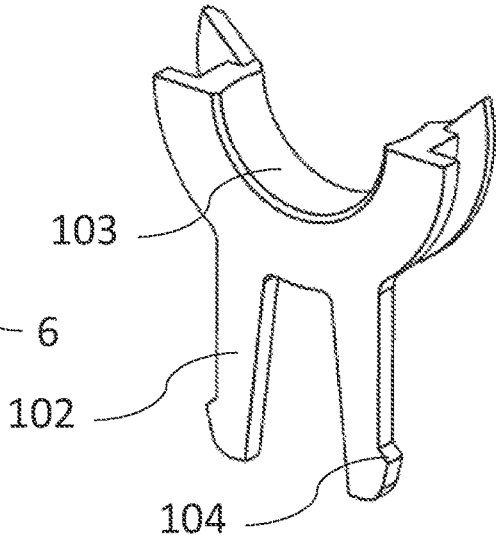
FIG. 9 shows a perspective view of the bushing of FIG. 1A.
Figure 8:
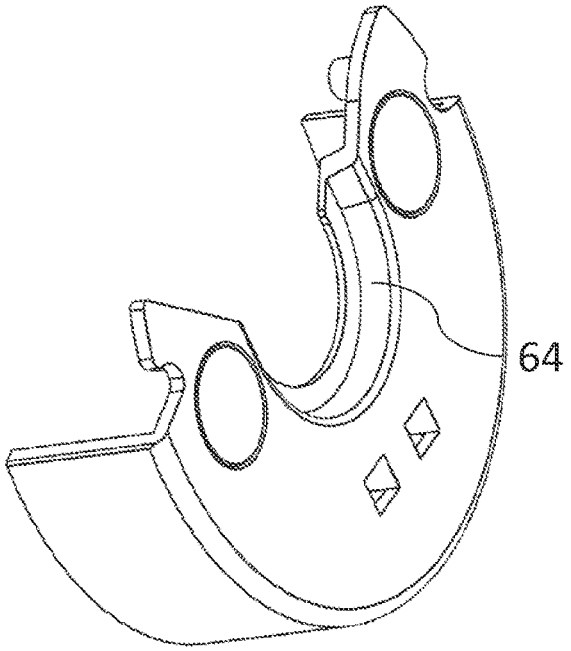
FIG. 8 shows a perspective view of FIG. 7 from the opposite side.
Figure 10:
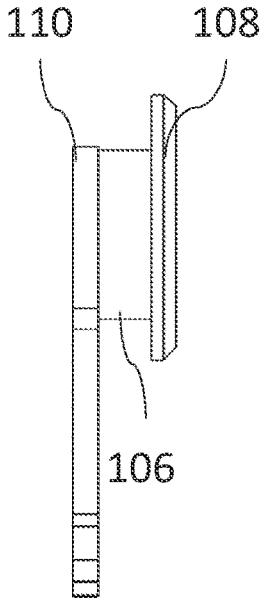
FIG. 10 shows a side view of the bushing of FIG. 1A.

The connection mechanism 2 includes an upper cover 4, a lower cover 6 and a bushing 10. Preferably the bushing 10 will be made of a more durable and wear resistant plastic than the covers 4/6. This more wear resistant plastic is often more expensive and thus minimizing the use of that material can save materials costs. For example, a more expensive/durable nylon or glass reinforced plastic might be used. As can be seen, the bushing 10 makes up the entire lower half of the pin opening—the area where the pin will exert the most pressure and wear. As shown in FIGS. 9 and 10, the bushing includes a flange 108 and a narrowed section 106. The narrowed section 106 fits into the recess 64 in the lower cover 6 and preferably the narrowed section 106 is primarily supported by the pivot support area 100 and shelf of the bracket 8. The pivot support area 100 is shown as circular in cross section and of a diameter slightly larger than the bearing surface 103 of the bushing 10. The bearing surface 103 may be curved in a concave manner to match the convex part 800 of the pin and thereby increase the amount of contact area and distribute wear over a larger part of the bushing than if the surface 103 were cylindrical. The mating concave/convex surface also assist in keeping the pin in position and inhibit movement along the pin axis 1000. The elongated section 110 of the bushing includes arms 102 with catches 104. These arms 102 insert into the opening of the opening of the retainer 60 in the lower cover 6 with the catches 104 inhibiting removal via a snap lock connection. The arms 102 in combination with the retainer 60 of the lower cover and the hole 82 in the bracket inhibit the bushing 10 from rotating as the seat rotates. The bushing 10 can be removed by pinching the arms 102 together and moving the bushing 10 vertically. The pinching disengages the catches 104.

A protrusion 65 is located adjacent the retainer and/or is part of the retainer. This protrusion is shaped to cooperatively fit into hole 82 (or part thereof) in a manner that inhibits side to side movement of the lower cover and/or rotational movement and/or up/down movement of the lower cover. This may be considered a key/keyway fit. As can be seen the upper and lower portions of the protrusion 65 are of the same curved shape as the upper and lower portions of the center section of the hole 82. This further inhibits movement of the lower cover relative to the bracket.

Figure 1C:
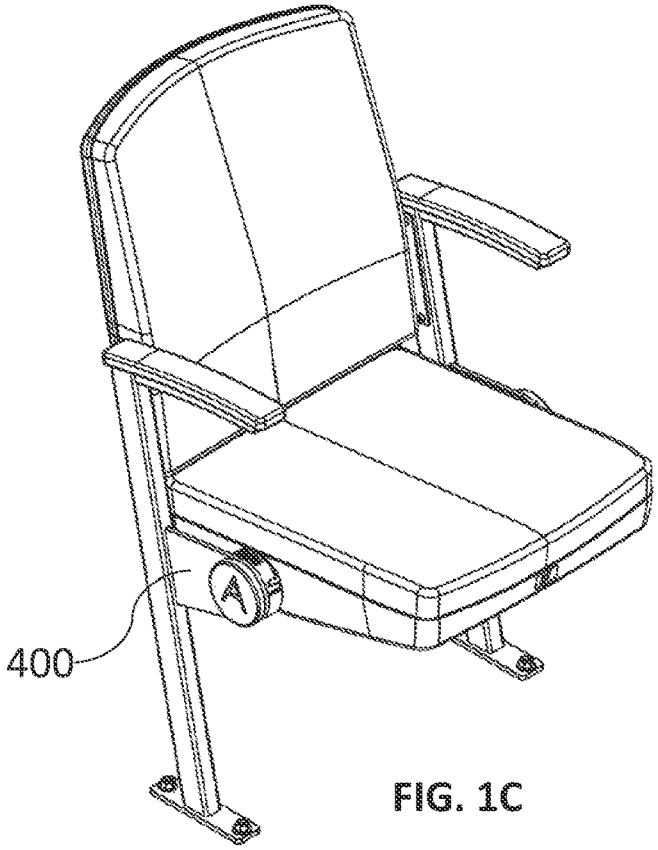
FIG. 1C is a perspective view of a chair having the mechanism of FIG. 1A-B.
Figure 2:
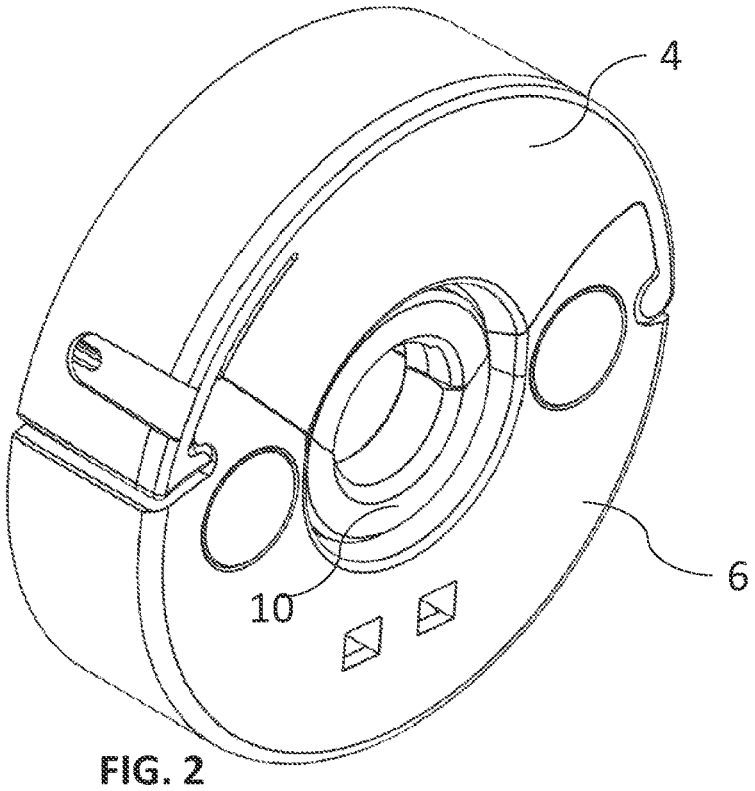
FIG. 2 is a perspective view of FIG. 1A from the opposite side.
Figure 3:
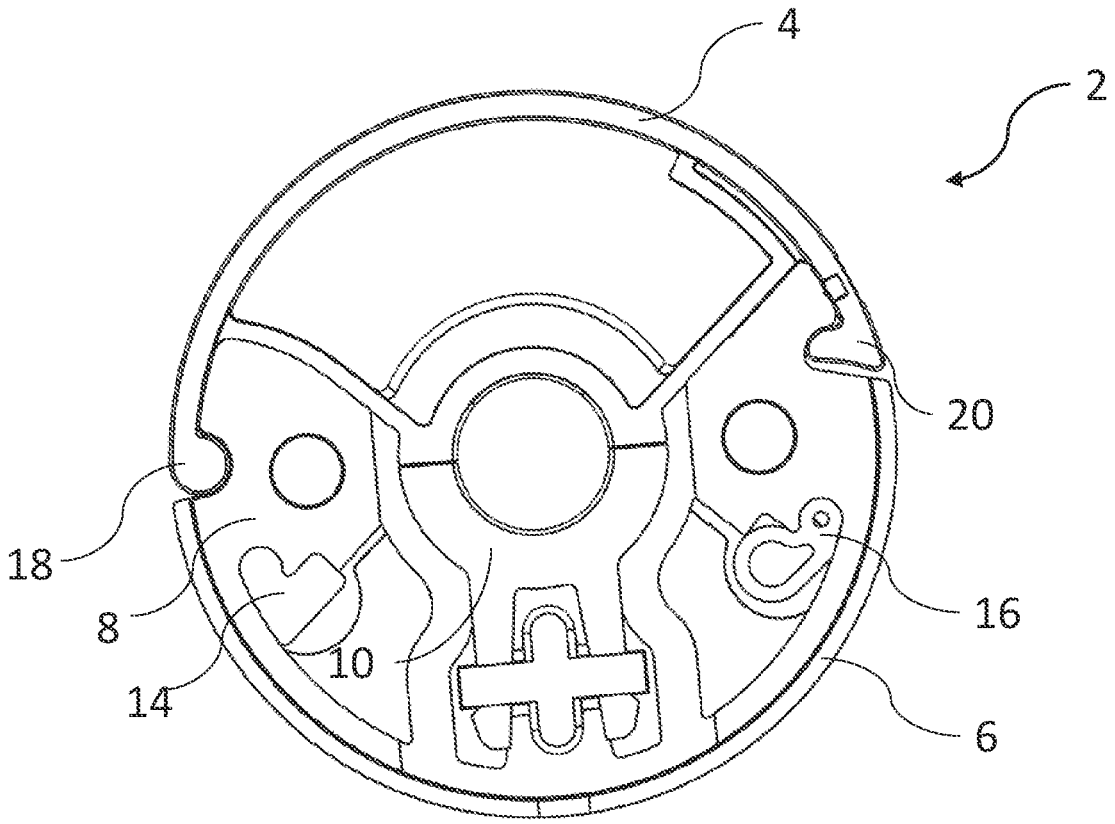
FIG. 3 is a rear view of the connection mechanism of FIG. 1A.
Figure 4:
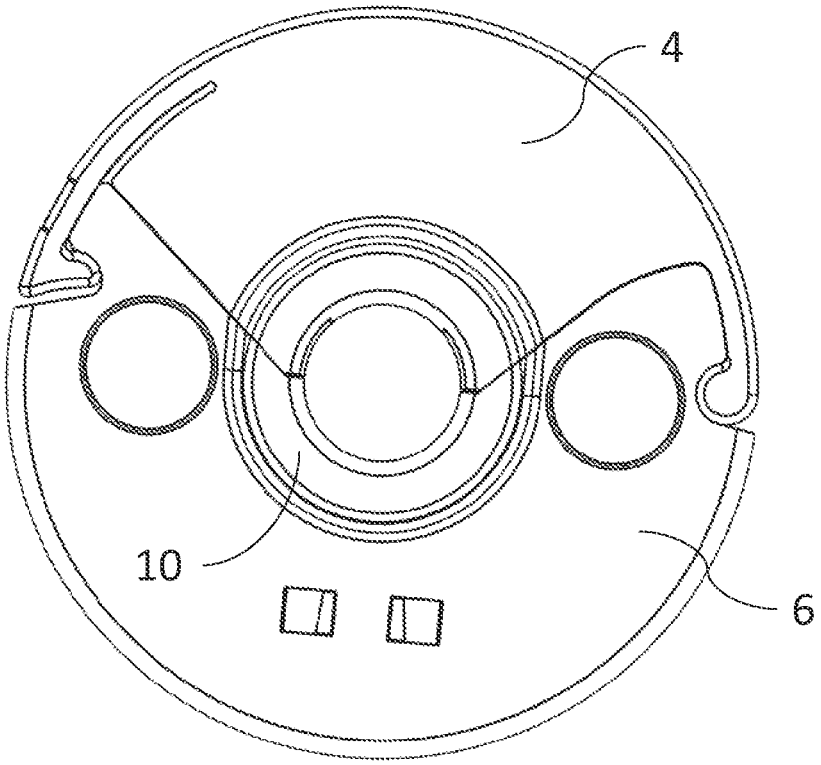
FIG. 4 is a front view of the connection mechanism of FIG. 1A.
Figure 5:
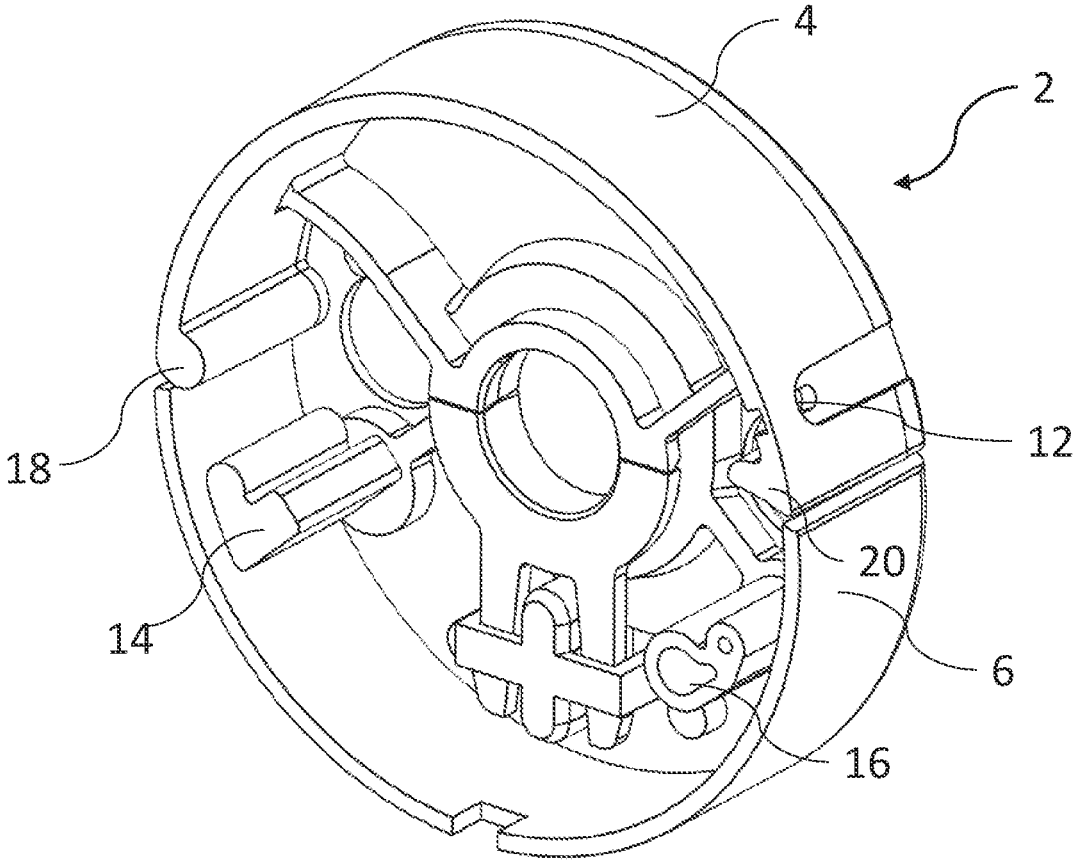
FIG. 5 depicts the same view as FIG. 1A but with the extruded bracket also removed.
Figure 14:
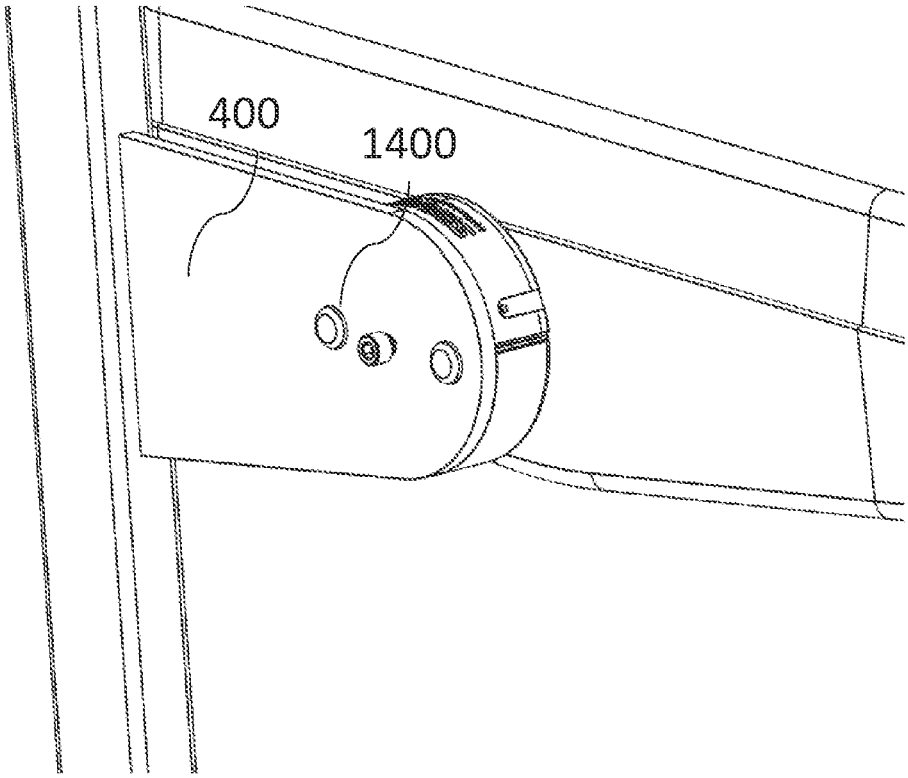
FIG. 14 is a detail perspective view showing how the bracket of FIG. 1A-B is attached to the chair.
Figure 15:
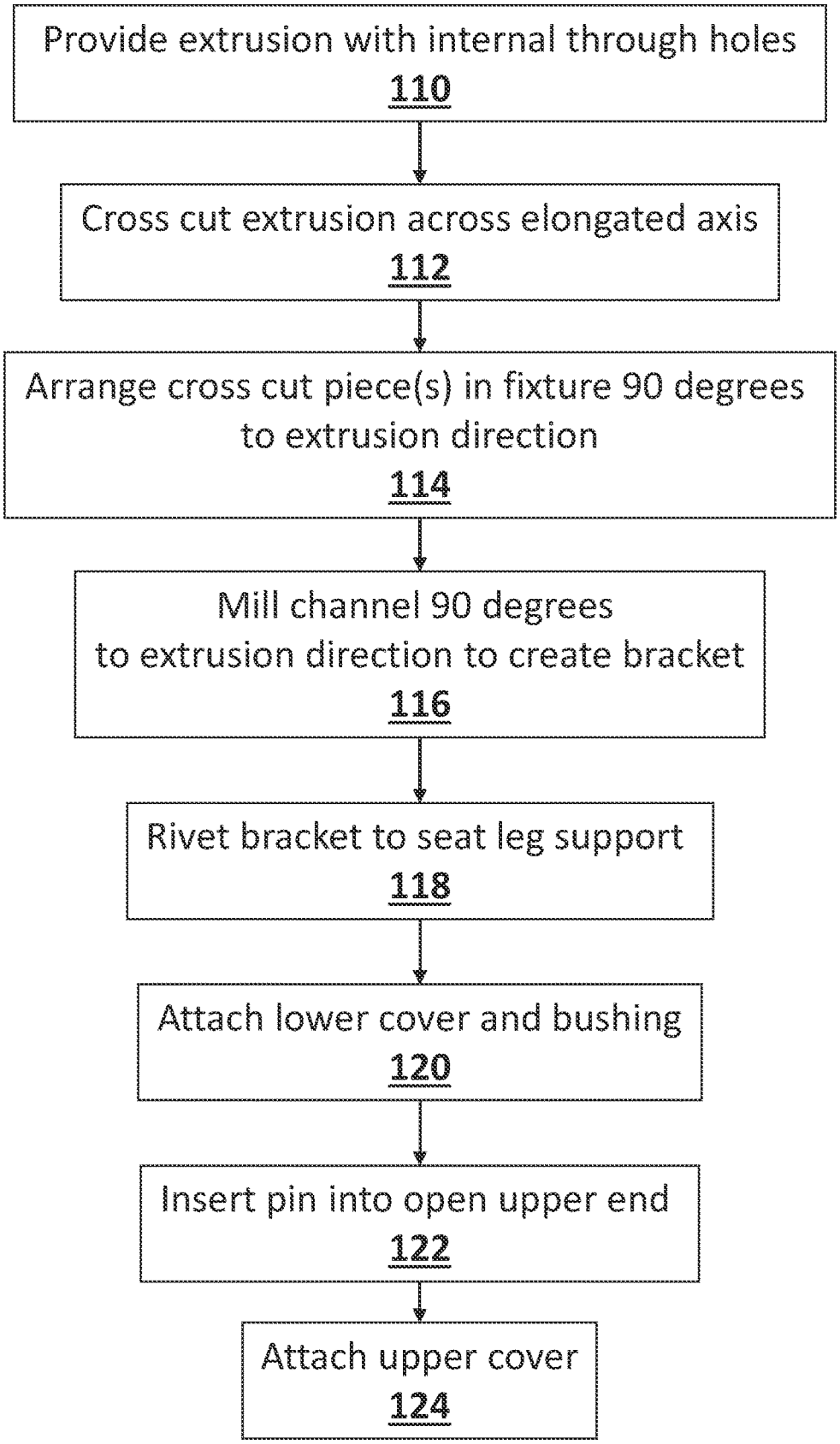
FIG. 15 is a flow diagram showing the manufacturing/assembly method for the bracket.

The lower cover 6 also includes drain hole 62. This drain hole is especially useful for outdoor applications where the seat is exposed to rain and also to allows liquids such as beverages to spill out the bottom of the bracket. The lower cover also includes stop protrusions 61/63 which can interact with bumpers 14/16 (also referred as stops) to ensure proper insertion/height. As can be seen in FIG. 1, the bumpers 14/16 fit into corresponding shaped openings in the bracket 8 and these openings and the shape of the bumpers 14/16 holds the bumpers in place vertically with the bumpers being prevented from sliding along their axis by the lower cover 6 together with the plate 400 the connection mechanism is mounted on which closes off the inside of the bracket shown to be open in FIG. 1A. As shown in FIG. 1C, the plate 400 is part of the seat support leg, preferably a plate welded to the vertical support of the seat. Preferably, the bracket connects to the plate 400 via rivets 1400 as shown in FIG. 14. The hex bolt shown in FIG. 14 is used to secure an exterior decorative cover assembly depicted in FIG. 1C but not shown in FIG. 14.

The bracket creates stops which limit rotational movement of the pin, these stops may be considered the solid part of the bracket which limits movement of the stop arm of the pin but may also be considered to include the bumper mounted to that part of the bracket in combination or alone, for example. It is contemplated that the bumpers and their slots could not be included and instead a bumper attached to the stop arm of the pin. The purpose of the bumper is to absorb/dampen the movement of the seat, ideally limiting noise. As a result, the seat can pivot between open and closed positions with the seat rotating through approximately 90 degrees. The pin arm 804 will either stop at stop 14 or stop 16, depending on if the user is sitting on the seat or not. The arm 804 as shown is two sided in that the lower side rotates within the lower portion of the bracket and impacts the rubber/rubber-like/elastomeric stops 14/16. The upper portion of the arm 804 may also impact the upper portion of the bracket to inhibit further rotation. The rotation paths and dimensions may be arranged such that the arm 804 will hit the stops 14/16 first and cause compression to a certain extent and then rest against the upper portions of the bracket to create metal on metal contact which will eliminate or at least inhibit further compression of the stops 14/16.

As can be seen, the retainer/catches 60 combined with the arms 102 of the bushing inhibit the lower cover 6 from moving away from the bracket 8 along the pivot axis 1000 of the pin as the retainer 60 would need to move out of hole 82 and this is inhibited by the arms 102. Further, the catch 104 holds the lower cover up onto the bracket 8 so that the lower cover cannot fall/drop down. Also, the retainer 60 interacts with hole 82 to inhibit the lower cover falling/dropping down and this interaction also prevents the bushing from rotating as the bushing arms are held by the retainer 60 and then the retainer would need to rotate for the bushing to rotate, however such rotation is prevented by the sides of the hole 82.

Openings 85/87 formed in the extrusion allow for the pin arm 804 to rotate within the bracket to allow the seat to move from occupied to unoccupied positions. Shelf 83 further assists to inhibit the bushing 10 from moving along the pin axis 1000 which is generally arranged according to the longitudinal direction of the square cross section part 802 of the pin. Although a square section is shown, other non-cylindrical shapes can be used. The seat of the chair has a cooperatively shaped receiver the non-cylindrical section 802 of the pin fits in so that the pin cannot rotate relative to the seat, but when the seat rotates, this causes the pin to rotate.

It is understood that the axis can vary slightly to not be perfectly perpendicular as the pin provides a curved section which may be a spherical or ellipsoid section 800 which rotates in the bushing 10 to allow for adjustments of the pin axis 1000 in and out. This can accommodate curved rows, however there are limits to the ability for this pin axis to depart from perfectly perpendicular as the arm 804 of the pin could become jammed against the bracket or otherwise the bracket may interfere with rotation if the pin axis 1000 is moved too far away from perpendicular. The axis can be adjusted fore and aft generally an equal amount. Thus, the axis 1000 can be considered approximately or substantially perpendicular to the bracket. Generally, holes 89/89' will be parallel each other and perfectly perpendicular to the faces of the bracket, such as inner face 83 and parallel the wall 84 of the channel as these holes 89/89' are formed by extrusion.

The upper cover includes snap in protrusions 18/20 which allow for a hinged connection of the upper cover. Thus, the upper cover can be removed and the pin arm 804 oriented in the appropriate direction aligned with the channel 84 to insert/remove the chair's seat, preferably, the seat is inserted from above the bracket. The upper cover 4 can then be snapped in place and a set screw added to the bracket at area 12. With the pin arm 804 outside the range of angles where it can be inserted/removed, the pin arm and therefore the seat is retained within the connection mechanism.

If there is future need to replace a worn out bushing, the upper cover 4 can be removed, the seat pivoted to the appropriate angle for insertion/removal and the seat removed. The bushing's arms 102 can be pressed together and the bushing removed and replaced. The mechanism can be re-assembled in reverse.

In preferred embodiments, the upper 4 and lower 6 covers along with the bushing 10 are injection molded with the busing preferably formed from a more wear resistant material. For example, a fiber reinforced injection molded plastic, e.g. glass filled nylon may be used for the bushing 10 to provide improved wear resistance whereas the upper 4 and lower 6 covers may be formed of high or low density poly ethylene (HDPE or LDPE) or others. Thus, the bushing may be formed from a different plastic/material than the covers 4/6. As stated previously, the bracket 8 is preferably a metal extrusion, for example aluminum or steel alloys may be used, but other materials may be used. The bumpers 14/16 may be formed of a plasticized or rubberized material such as a synthetic rubber, rubber or other low durometer materials. These bumpers are designed to absorb motion and noise created by the pin's arm moving back and forth between occupied and unoccupied positions of the seat.

Figure 11:
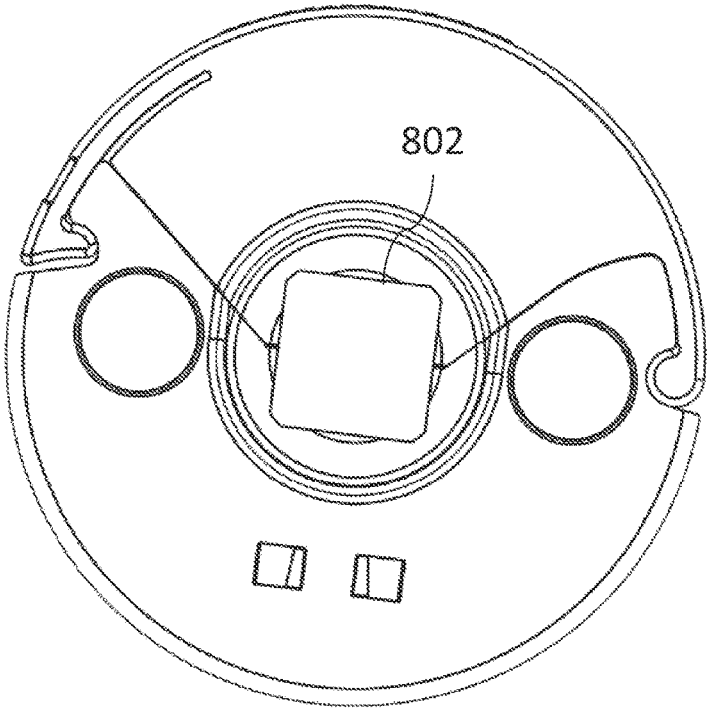
FIG. 11 is a view of FIG. 4 but with the pin shown.
Figure 12:
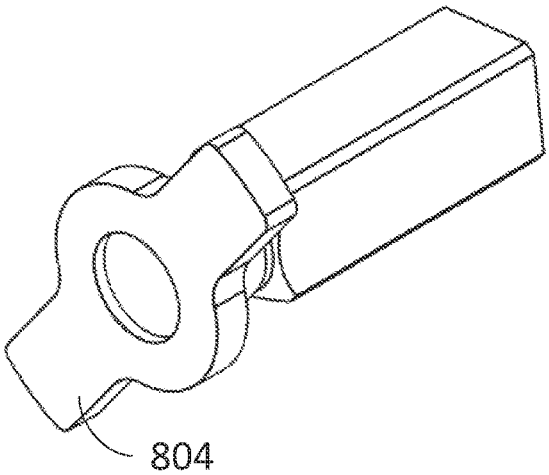
FIG. 12 is a perspective view of the pin of FIG. 1B.
Figure 13:
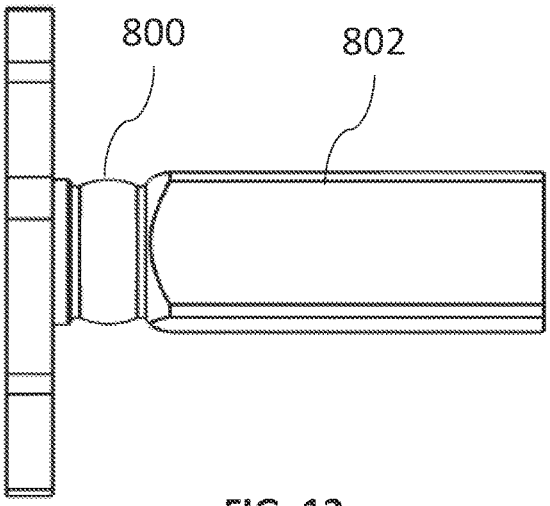
FIG. 13 is a side view of the pin of FIG. 12.

Referring to FIG. 11, the process of making and assembling the connection mechanism is shown. An extrusion is created by pushing metal through a die to result in an elongated extrusion with holes matching that of the bracket 8, but without the channel 84 cut therein. This extrusion is provide 110 and then cross cut 112, for example using a band saw, water jet, laser cutter or other machining technique for creating cross cuts across the longitudinal direction of the extrusion. The cross cut face (or the face parallel to that face) is placed facing upwards on a jig which holds the cross cut pieces 114. Next, a square cross section mill is moved 90 degrees to the extrusion direction 116 to cut channel 84. The bracket 8 is then riveted 118 to the seat leg support. The lower cover and bushings are attached 120. The result is an open upper end of the bracket. The stop arm of the pin is aligned with this opening to insert into the channel 84 so that the pin is inserted into the open upper end 122. The pin, particularly the spherical part thereof, rests against the bushing. The upper cover 124 is then attached to fully enclose the bracket in a manner that inhibits objects from falling into the bracket and impeding its operation and also in a manner that inhibits fingers from becoming pinched as the seat pivots.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A seat connection mechanism comprising:

a bracket portion which is metallic including a pivot support and two stops;

a pin portion which includes a support portion and a stop portion;

a polymeric bushing which inserts into the bracket portion at the pivot support in a fixed rotational position relative to the bracket portion such that the busing is located between the pivot support and the support portion of the pin portion;

a cover portion which is configured to cover an open upper portion of the bracket portion;

wherein the pin portion is configured to rotate in contact with the polymeric bushing such that the stop portion of the pin portion moves between the two stops of the bracket portion; and wherein the cover portion is polymeric and wherein the polymeric material of the bushing and a polymeric material of the cover are different.

2. The device of claim 1 wherein the bracket portion is a metallic extrusion and further comprising:

a channel in the bracket portion arranged approximately perpendicular to an extrusion direction of the metallic extrusion.

3. The device of claim 2 wherein the channel passes adjacent the pivot support.

4. The device of claim 1 further comprising an open lower portion on the bracket portion and a second cover portion configured to cover the open lower portion.

5. The device of claim 4 wherein the second cover portion and the polymeric bushing are configured to interact to hold themselves together to secure both the polymeric bushing and the second cover portion to the bracket portion.

6. The device of claim 1 wherein the polymeric bushing is configured to connect to a lower cover to hold the lower cover relative to the bracket portion.

7. The device of claim 6 wherein the connection between the polymeric bushing and the lower cover inhibits movement of the lower cover in an axial direction of the pin portion.

8. The device of claim 6 wherein the lower cover includes catches which interact with the bracket portion to hold the lower cover to the bracket portion.

9. The device of claim 2 wherein the channel is arranged on an inward facing side of the bracket portion and the polymeric bushing is configured to connect to a lower cover to inhibit the lower cover from moving outwards.

10. The device of claim 9 wherein the lower cover includes a face which abuts an outer surface of the bracket portion to inhibit the cover from moving inward.

11. A seat rotation mechanism comprising:

a bracket comprising a pivot support region and at least one stop region;

a bushing made of a polymeric material;

a cover configured to at least partially cover the bracket;

a seat comprising a pin, the pin configured to rotate in contact with the bushing;

wherein the bushing is configured to fit in the pivot support region such that the bushing is supported by the bracket and the bushing is configured to interact with the cover such that the cover inhibits removal of the bushing from the pivot support region and the bushing interacts with the cover to inhibit removal of the cover from the bracket.

12. The mechanism of claim 11 wherein the cover is polymeric and wherein the polymeric material of the bushing and a polymeric material of the cover are different.

13. The mechanism of claim 11 wherein the cover is a different color than: the bushing, the metal bracket, or combinations thereof.

14. The mechanism of claim 11 further comprising a top cover configured to enclose an upper end of the mechanism and wherein the cover is a lower cover configured to enclose a lower end of the mechanism.

15. The mechanism of claim 11 wherein the bushing interacts with the cover to inhibit movement of the bushing in an upwards direction away from the pivot support region.

16. The mechanism of claim 11 wherein the bushing interacts with the cover to inhibit movement of the cover in a sideways direction.

17. The mechanism of claim 11 wherein the bushing remains in a fixed rotational position relative to the bracket portion when the pin rotates against the bushing.

18. The mechanism of claim 17 wherein the at least part of the cover inserts through an opening in the bracket portion and the bushing interacts with the at least part of the cover which inserts through the opening to thereby inhibit rotation of the bushing.

* * * * *